US006719020B1

(12) United States Patent
Bisotto

(10) Patent No.: US 6,719,020 B1
(45) Date of Patent: Apr. 13, 2004

(54) DEVICE FOR THE INFLATION OF AN ELASTIC, TRANSLUCENT OBJECT, SPECIFICALLY A BALLOON

(76) Inventor: Riccardo Bisotto, 2nd Floor, 26 Sussex Pl, London W2 2th (GB)

( * ) Notice: Subject to any disclaimer, the term of this patent is extended or adjusted under 35 U.S.C. 154(b) by 447 days.

(21) Appl. No.: 09/607,459

(22) Filed: Jun. 29, 2000

(30) Foreign Application Priority Data

May 17, 2000 (DE) ..... 100 25 653

(51) Int. Cl.[7] ..... B65B 1/04; B65B 3/04; B67C 3/00

(52) U.S. Cl. ..... 141/313; 141/67; 141/100; 141/105; 141/107; 141/113; 141/114; 141/391

(58) Field of Search ..... 141/67, 100, 105, 141/107, 113, 114, 313, 314, 351, 382, 391, 392; 446/220; 53/79

(56) References Cited

U.S. PATENT DOCUMENTS 4,955,412 A * 9/1990 Younts et al. ..... 141/114
5,067,301 A * 11/1991 Shore ..... 53/79
5,421,518 A * 6/1995 Robisch et al. ..... 239/311

* cited by examiner

*Primary Examiner*—Timothy L. Maust

(57) ABSTRACT

A device for inflating an elastic, translucent object, specifically a balloon which encloses a nozzle that can be inserted into an opening of the object, whose nozzle bore hole is connected to a compressed gas line, having a self-activating, resettable, release lever for manually controlling the compressed gas flow, designated in such a way so that the nozzle bore hole is connected to at least one paint cartridge, which can contain liquid paint and upon activation of the release lever the paint together with the compressed gas can flow into the inside of the object.

11 Claims, 3 Drawing Sheets

DEVICE FOR THE INFLATION OF AN ELASTIC, TRANSLUCENT OBJECT, SPECIFICALLY A BALLOON

CROSS-REFERENCES TO RELATED APPLICATIONS

The present application claim the priority date of Germany application 100 25 653.8 filed May 24, 2000.

BACKGROUND OF THE INVENTION

The invention applies to a device for the inflation of an elastic, translucent object, in particular a balloon, having a nozzle that can be fitted into an opening of the object, the nozzle bore hole of which is connected to a pressurized gas line with a resetting, self-actuated, release lever for manual operation of the compressed gas supply.

To make an elastic, translucent object, such as a balloon, optically more attractive, the coloring or printing of the raw material takes place during the production process. These creative measures do not allow for individuality of the object, since they are applicable only for the production of relatively large quantities.

Using a so-called compressed air gun in addition to the manual air pump for inflating such an object is customary. The compressed air gun is connected to a pressurized gas line with a container for compressed pressurized gas, where, in addition to air, other gas mixtures can also be used as compressed gas. The compressed air gun is used in the customary way, by which upon activation of a release lever, compressed gas streams through or into a nozzle which is placed in the opening of the object, [and flows] to the object. After the desired inner pressure of the object has been obtained, the resetting, self-actuated, release lever is released, which stops the supply of compressed gas.

Finally, it is known that to produce one individual balloon, it has to be filled with a minimum amount of color and inflated. This will create an appealing balloon, however, this procedure cannot be used for commercial inflation of balloons in large quantities, since preparing each balloon in this way is relatively expensive.

BRIEF SUMMARY OF THE INVENTION

It is the goal of the invention, to find a device, as indicated initially, that will allow the individual creation of an elastic, translucent object, which upon being inflated, will allow that procedure to occur relatively quickly and cost-effectively.

According to the invention, the problem is solved if the nozzle bore hole is connected to at least one paint cartridge containing liquid paint, and upon activation of the release lever, the paint together with the compressed gas can flow into the object.

Based on these procedures, the individual creation of an inflatable as well as translucent object can be guaranteed during its inflation, without additional expense within the shortest period of time. The flow rate of the compressed gas brings paint to the interior of the object, which could, for example, be air, or any other desired gas mixture and is distributed there. By using a large quantity of paint, the object can be colored evenly almost completely. If only a small amount is brought inside the object, the paint will be distributed unevenly and optically pleasing patterns will result.

A nozzle in the shape of a lance is preferred, which is sealed to a pistol-formed housing, whereby the compressed gas line is lead to the nozzle bore hole through a grip end of the housing. The pistol shaped housing can be handled easily and the nozzle can be exchanged if desired. Due to the lance design of the nozzle, it can be inserted into the object relatively far and the object can be held around the nozzle in the open area by hand. The nozzle is equipped with a radius or a chamfer on its free end, so that the object is not damaged when the nozzle is placed inside.

It is most advantageous if the bore hole of the nozzle corresponds to the bore hole of one of the hollow cylinders within the housing, which is attached to a paint line leading to the paint cartridge. It will thus allow an easy exchange of the nozzle and the paint line is contained inside the housing. Several paint cartridges with corresponding paint lines could, of course, be provided.

To avoid contamination of the compressed gas line by paint, it is best if the bore hole on the opposite end of the nozzle bore hole is expanded to a compressed gas line by means of a pressure bore hole, which is sealed by means of a sealing washer.

After an advantageous design of the invention, a spring-weighed nozzle rod is loosely placed into the nozzle bore hole as well as the bore hole and the pressure bore hole of the hollow cylinder which is coupled with the release lever, where the nozzle rod, in the area of the pressure bore hole, has a conical nipple and is sealed in the sealing washer. The nozzle rod ensures the required cross-section of the flow which is needed for moving paint and in addition, for mixing paint with compressed gas.

It is most advantageous if the nozzle rod is equipped with an adjusting screw on the housing side which keeps the open end of the nozzle bore hole as well as the pressure bore hole in the direction of the hollow cylinder closed by means of a conical nipple, while the release lever is not activated. Upon the release of the self-activating, resetting release lever, the nozzle rod closes both the compressed gas supply line as well as the nozzle opening at the same time, so that neither paint nor compressed gas can get inside the object from the nozzle.

It is most advantageous if an annular space is provided between the nozzle rod as well as the bore hole of the hollow cylinder and the nozzle bore hole for mixing paint. Before entering the inside of the object, the various colors will be mixed with each other and with the compressed air in this annular space.

According to an alternative design of the invention, a nozzle rod is placed into the nozzle bore hole as well as the bore hole and the pressure bore hole of the hollow cylinder and is connected to the housing which divides the bore hole and the pressure bore hole into a number of chambers. They correspond to the respective paint cartridges, whereby each chamber is connected to the respective paint cartridge by means of a paint line. Thus, a relatively simple mechanical mechanism can be made available, having a minimum of moving parts. A release lever for the supply of the compressed gas, can, for example, be attached to a corresponding compressed gas bottle, a compressor or something similar.

To regulate the paint supply individually, a proportioning chamber with an elastic exterior wall is preferably set up in each chamber. By finger-pressure on the elastic exterior wall, the cross-section of the flow is constricted and a reduced amount of paint from the respective chamber will flow to the inside of the object. The finger-pressure on the chamber can be increased until the supply of paint is almost completely stopped.

It is most advantageous if each paint line has a check valve installed in the area of the paint cartridge. The check valve prevents paint from running out of the paint cartridge, due to the vacuum which exists because of the flow of compressed gas in the bore hole, it opens, so that paint can be taken in from the paint cartridge and it reaches the nozzle.

It is understood that the previously named and following still to be explained characteristics cannot only be used in the combinations named, but also in other combinations, without leaving the framework of the invention at hand.

BRIEF DESCRIPTION OF THE SEVERAL VIEWS OF THE DRAWINGS

The invention will be explained more in detail as follows, using two design examples, with reference to the respective illustrations.

DETAILED DESCRIPTION OF THE INVENTION

Figure 1:
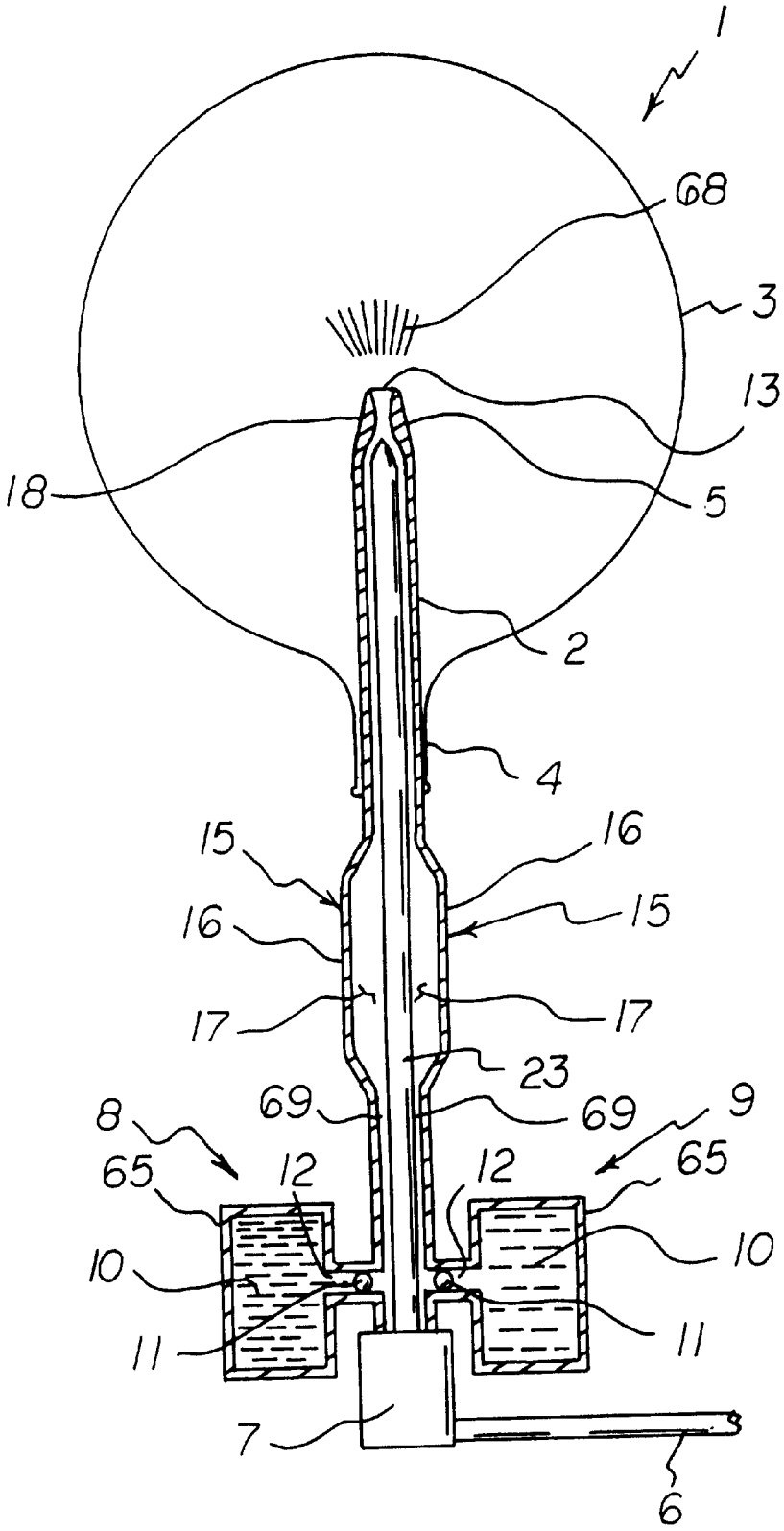
FIG. 1 is a section of a schematic representation of the device according to the invention.

According to FIG. 1, a lance-shaped nozzle 2 of the device is inserted into the mouthpiece 4 of an object 1 such as a balloon 3. The mouthpiece 4 is held there manually. The nozzle 2 is inserted far into the balloon 3 with it's rounded off and beveled tip 5. At the tip 5 there is a nozzle opening 13, by means of which the balloon 3 is inflated. The device is supplied with compressed gas by means of a compressed gas line 6. The compressed gas is directed to a distributor 7. The distributor 7 has non represented valves as well as a pressure bore hole 40, through which the compressed gas is distributed in amount and pressure to two paint areas 8, 9. Each paint area 8, 9 is allocated to a stored paint reserve 10 of a paint cartridge 65, which is respectively directed to a chamber 69 with a nozzle rod 23 in a nozzle bore hole by means of a paint line 12 outfitted with a check valve 11 where the chambers 69 in the area of the tip 5 are brought together. A proportioning chamber 15 is set up in the nozzle bore hole 50 on the way to the tip 5.

When compressed gas flows through the nozzle bore hole 50, the check valve 11 placed in the paint line opens, due to the resulting vacuum, by means of which paint reaches the paint line 12 from the paint cartridge 65. There, a paint medium 17 is set up, made up of paint and compressed gas which flows in the direction of the nozzle opening 13, which fills the proportioning chamber 15 entirely. The paint medias 17 meet in the area of the tip 5 and are mixed together to create the paint mixture 68 which fills the interior of the balloon 3. The exterior wall 16 of the proportioning chamber 15 is elastic, which enables the previously chosen paint mixture to be changed manually by corresponding finger-pressure during inflation of the balloon 3.

The inflatable object maybe fully or only partly transparent and or partially translucent to advantageously result into the desired paint and effect or effects.

Figure 2:
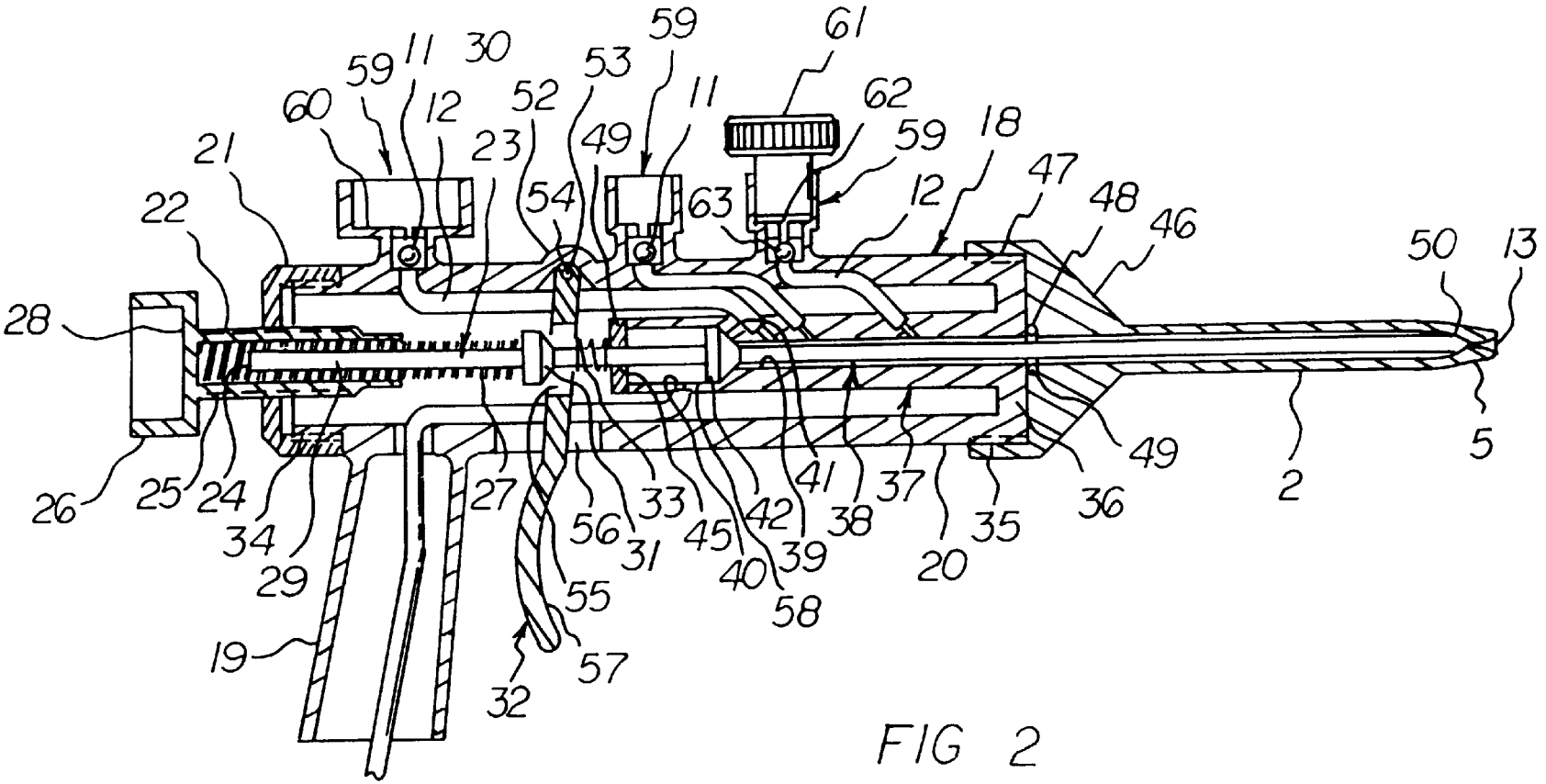
FIG. 2 is a sectional representation of the inoperative device in an alternative design.

FIG. 2 shows a device 1 in the shape of a pistol 18, surrounding a hollow grip end 19, through which the compressed gas line 6 is led. The grip end 19 is connected to the housing 20, which is basically cylindrical in shape. Located at the back end is a winding area 34 with a hexagonal cap nut 21 screwed on it. The hexagonal cap nut 21 contains an adjusting screw 22 which encompasses an exhibited threaded bolt 25 and an adjusting wheel 26 in a blind hole 24. The opening of the blind hole 24 points to the inside of the housing 20 and a compression spring 27 dips into it which is supported by the floor 28 of the blind hole 24. In addition, a continuation 29 of the nozzle rod 23 dips into the compression spring, which is long enough to still lie within the blind hole 24. Toward the middle, the continuation 29 has a thrust piece 30, which supports the end of the compression spring 27 that extends into the housing 20 which has the nozzle rod 23 attached to it. The flat part of the ball 31 is attached to the thrust piece 30 on the opposite side which adjoins the release lever 32 which has a tension spring 33. The tension spring 33 is weaker than the compression spring 27 and only affects the proximity of the release lever 32 on the flat part of the ball 31.

The adjusting screw 22 at the opposite end of the housing 20 has an external winding 35 onto which the nozzle 2 is screwed. In this area, the housing 20 has a terminating wall 36, from which a hollow cylinder 37 extends into the inside of the housing 20. The hollow cylinder 37 has a graduated bore hole 38 inset which makes up boring hole 39 that corresponds to the nozzle bore hole 50 as well as a pressure bore hole 40 which lies across from the nozzle bore hole 50. A seal seat 41 has been placed in the transition from the boring hole 39 to the pressure bore hole 40, which contains a conical nipple 42 attached to the nozzle rod 23 and is moved by it. The compressed gas line 6 peripherally flows into the pressure bore hole 40 and the compressed gas flows through the pressure bore hole 40 and presses the conical nipple 42 into the seal seat 41, the same as the compression spring 27. Thus, the compressed gas cannot escape by way of the nozzle 2. A sealing disc 44 seals the pressure bore hole 40 toward the inside of the housing 20, where there is a through hole 45 in the sealing disc 44 for the nozzle rod 23. The through hole 45 has been set up in such a way so that the nozzle rod 23 is sealed while sliding in it.

The nozzle opening 13 is located at the tip 5 of nozzle 2 which is shaped like an injection lance. On the end that faces the housing 20, the nozzle 2 has a transition 46 in the shape of a truncated cone, which contains an internal winding 47 into which the external winding 35 of the housing 20 is screwed. An offset 48 for receiving a seal ring 49 has been placed into the flat part of the transition 46, which lies adjacent to the terminating wall 36 of the housing 20. The seal ring 49 assures that the area between transition 46 and the terminating wall 36 is sealed.

The nozzle bore hole 50, which has the same diameter as the bore hole 39, runs through the entire nozzle 2 and is tapered in the area of the tip 5 to the nozzle opening 13. The seal of the nozzle opening 13 is effected by the nozzle rod 23, which is pushed in the direction of the nozzle opening 13 by means of a compression spring 27, located in the adjusting screw 22. The tapered end forms the rod seat 51 and prevents the paint medium 17 from escaping while the pistol 18 is not engaged. The pistol 18 is engaged by means of the release lever 32.

An eye 52 has been created on the opposite side of the housing 20 on the grip end 19 which contains a bearing 53 for the swiveling bearing of a lever bearing 54 of the release lever 32. In addition, the release lever 32 shows an opening 55 through which the nozzle rod 23 protrudes. On the opposite side of the eye 52 a relief 56 has been incorporated in the housing 20, through which the recessed grip end 57 of the release lever 32 protrudes.

At the place where the compressed gas line 6 enters the pressure bore hole 40, a small impression 58 has been made on the inner side of the pressure bore hole 40 in the direction of the conical nipple 42, which will allow a slight amount of the compressed gas to pass even when the release lever 32 has not been activated entirely.

Screw sockets 59 have been added to the exterior of the housing 20 on the side of the eye 52. A paint line 12 runs from the floor 60 of each of the screw sockets 59 to the bore hole 39 leading to the pressure bore hole 40 and the terminating wall 36, ending in the later. A check valve 11 has been provided between the paint line 12 and the floor 60. The screw socket 59 at the rear as well as the provided paint line 12 have greater diameters to allow a larger paint cartridge 65 to be screwed in for the one and achieve a higher flow rate for the other. The frontal screw socket 59 contains a screwed-in plug 61, whose stub 62 presses down on the ball 63 of the check valve 11 and seals the paint line 12.

Apart from paint or paints also many other substances maybe used with this spraying adaptor.

The new adaptor may also operate with liquid and or substances in powder form which maybe introduced during and or after inflation. The powder format will further facilitate to absorb the liquid substance or substances Another substance maybe sprayed instantaneously and or at a later time, which will dilute and or prepare and or dry the area to be sprayed.

Figures 3, 4, 5:
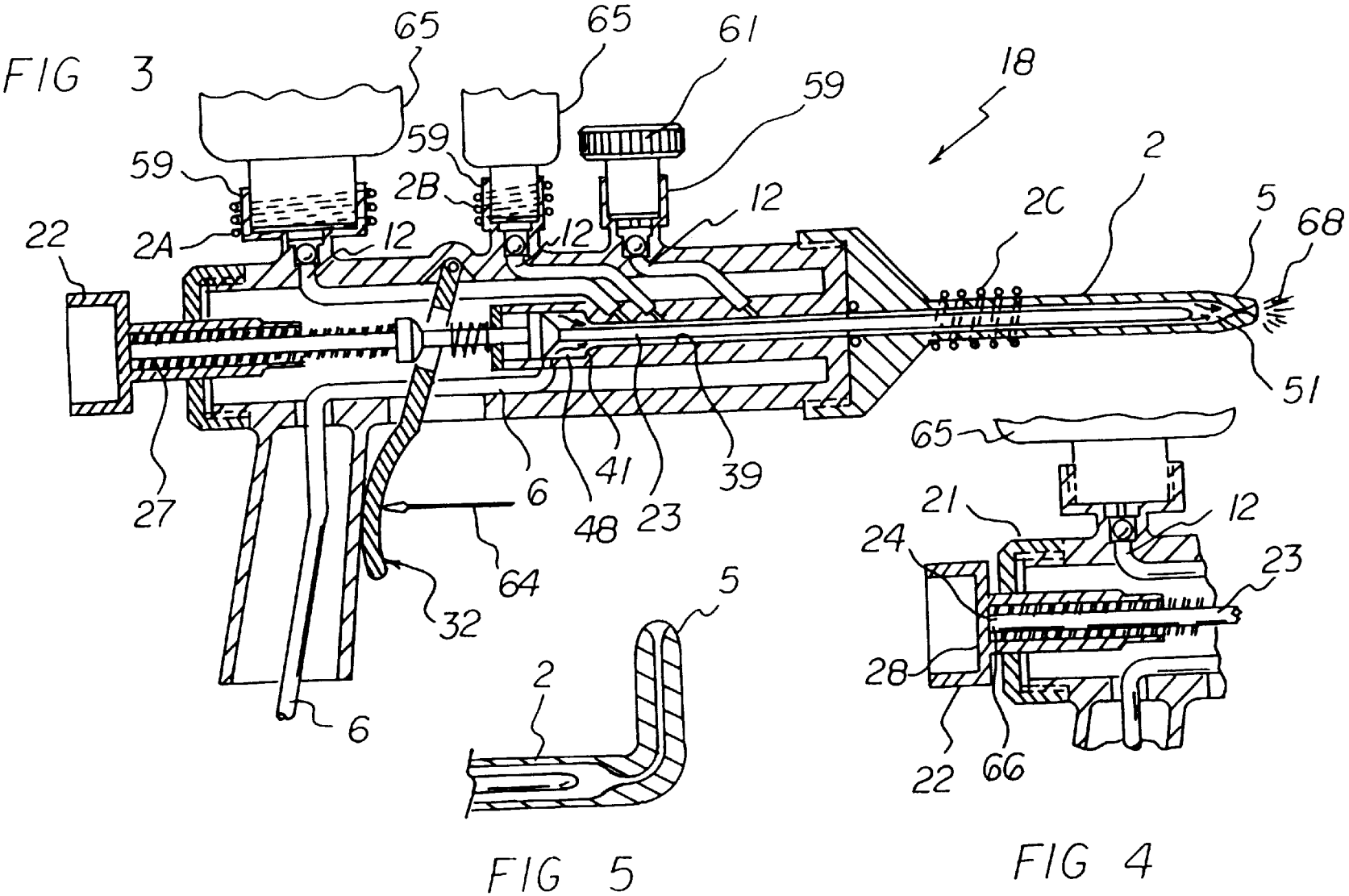
FIG. 3 is a sectional representation of the operative device according to FIG. 2.
FIG. 4 is a detail of the left end of FIG. 3 in a fixed position.
FIG. 5 is a cross sectional view of an alternate embodiment of the invention.

FIG. 3 shows a pistol 18 in use. Paint cartridges 65 have been screwed into both free screw sockets 59. The release lever 32 has been moved in the direction of the arrow. The nozzle rod 23 has been moved to the back against the force of the compression spring 27 and the compressed gas line 6 is free in the pressure bore hole 40, which allows compressed gas to flow into the bore hole 39. In addition, the rod seat 51 at the tip 5 of the nozzle 2 is open. A vacuum in the paint lines 12 results from the flow and consequently, upon the simultaneous opening of the check valves 11, paint is drawn from the paint cartridges. The paint comes together in the bore hole 39, gets mixed and is transported to the inside of the balloon by means of nozzle 2 from the nozzle opening 13 as a paint mixture 68.

Upon the release of the release lever 32, it is pushed forward by means of the compression spring 27 acting on the nozzle rod 23 and the action upon the seal seat 41 as well as the rod seat 51 are sealed by the nozzle rod 23. The check valves 11 seal the paint cartridges 65 and no paint can follow.

To avoid an accidental activation, as shown in FIG. 4, the adjusting screw 22 is screwed completely into the hexagonal cap nut 21. In this way, the end of the nozzle rod 66 is against the floor 28 of the blind hole 24 and the nozzle rod 23 is solidly in place. Activating the release lever 32 is no longer possible.

A heating and or a cooling element 2*a*, 2*b*, 2*c* are in alternate embodiments, attached and or incorporated into the unit. This will advantageously facilitate the operation of the unit in extreme circumstances and further result the sprayable paint or paints into different effects. Hot or warm air or gas may be further introduced at anytime to dry the liquid and/or substances, and, in addition, to further hinder the leakage or leakages of gasses from the balloon.

A cleaning mechanism should advantageously be incorporated and/or added and/or attached as the substances are, and/or may be of a very sticky, adhesive nature. Therefore it will be very helpful indeed if before and/or during and/or after the operating of the device, the substances may have been subjected to, and/or advantageously have a cleaning fluid and/or air and/or gas pass through the appropriate parts of the device, to ensure that it will be operational for a longer time span. This will ensure that the device can be readily used and operated to give the enjoyed results, if and when so desired. Further it will be advantageous if this device can be used at will and/or be of a self-cleaning nature.

Further attachments maybe added to the adaptor. This attachment or attachments may advantageously have a air vent to ensure the air or gas outlets remain under pressure. This will have the result that when the spray adaptor is activated the fluid or substances will spray into this embodiment and may color only this part while further inflating the rest. This embodiment may be of any shape, number, logo, and figure and may form part of the new inflatable object. This is further facilitated as paint and substances are heavier than air, helium or gas. The spray adaptor may have an opening spiral format to facilitates the evenly spraying of the substances.

A curve 71 maybe attached or incorporated to the adaptor to facilitate the holding of the neck of the object in place while being inflated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

REFERENCE LIST

1 object
2 nozzle
3 balloon
4 mouthpiece
5 tip
6 compressed gas line
7 distributor
8 paint area
9 paint area
10 paint reserve
11 check valve
12 paint line
13 nozzle opening
14 - - -
15 proportioning chamber
16 exterior wall
17 paint medium
18 pistol
19 grip end
20 housing

21 hexagonal cap nut
22 adjusting screw
23 nozzle rod
24 blind hole
25 threaded bolt
26 adjusting wheel
27 compression spring
28 floor of 24
29 continuation
30 thrust piece
31 flat part of ball
32 release lever
33 tension spring
34 winding area
35 external winding
36 terminating wall
37 hollow cylinder
38 graduated bore hole
39 bore hole
40 pressure bore hole
41 seal seat
42 conical nipple
43 - - -
44 sealing disc
45 through hole
46 transition
47 internal winding
48 offset
49 seal ring
50 nozzle bore hole
51 rod seat
53 eye
53 bearing
54 lever bearing
55 opening
56 relief
57 recessed grip
58 impression
59 screw socket
60 floor of 59
61 plug
62 stub
63 ball
64 arrow
65 paint cartridges
66 nozzle rod end
67 - - -
68 paint mixture
69 chamber

What is claimed is:

1. A device for inflating an elastic, translucent balloon with an opening, the device having a housing with a nozzle in the shape of a lance, with an elongated cylindrical exterior surface adapted to support the balloon while gas and paint are simultaneously being dispensed through the nozzle into the supported balloon wherein the nozzle has a bore hole which is connected to a compressed gas line, and having a self-activating, resettable, release lever for manually controlling the compressed gas flow, designated in such a way so that the bore hole of the nozzle is connected to at least one paint cartridge containing liquid paint and upon activation of the release lever the paint together with the compressed gas can flow into the inside of the supported balloon.

2. A device according to claim 1, designated in such a way that the nozzle is sealed in the housing whereby the compressed gas line is led through the housing to the bore hole of the nozzle.

3. A device according to claim 1, designated in such a way that the bore hole of the nozzle corresponds with a bore hole of a hollow cylinder within the housing for flowing into a paint line connected to a paint cartridge.

4. A device according to claim 3,designated in such a way that the bore hole of the hollow cylinder is on the opposite end of the bore hole of the nozzle and is enlarged to a pressure bore hole connected to a compressed gas line which is sealed by means of a sealing disc.

5. A device for inflating an elastic, translucent balloon, the device having a housing with a nozzle in the shape of a lance, with an elongated cylindrical exterior surface adapted to support the balloon while gas and paint are simultaneously being dispensed through the nozzle into the supported balloon, the nozzle having a bore hole which is connected to a compressed gas line, and having a self-activating, resettable, release lever for manually controlling the compressed gas flow, the bore hole of the nozzle being connected to at least one paint cartridge which contains liquid paint whereby upon activation of the release lever the paint together with the compressed gas can flow into the inside of the supported balloon, and further including a spring-loaded nozzle rod connected to the release lever which is set into the bore hole of the nozzle as well as the bore hole and the pressure bore hole of the hollow cylinder, whereby the nozzle rod in the area of the pressure bore hole is outfitted with a conical nipple and is sealed within the sealing disc.

6. A device according to claim 5, designated in such a way that the nozzle rod is connected functionally with an adjusting screw on the housing and which upon the non activation of the release lever, closes an open end of the bore hole of the nozzle as well as the pressure bore hole by means of a conical nipple in the direction of the bore hole of the hollow cylinder.

7. A device according to one of claim 1, designated in such a way that an annulus for mixing of paint is created between the nozzle rod as well as the bore hole of the hollow cylinder and the bore hole of the nozzle.

8. A device for inflating an elastic, translucent balloon, the device having a housing with a nozzle in the shape of a lance, with an elongated cylindrical exterior surface adapted to support the balloon while gas and paint are simultaneously being dispensed through the nozzle into the supported balloon, the nozzle having a bore hole which is connected to a compressed gas line and having a self-activating, resettable, release lever for manually controlling the compressed gas flow, the bore hole of the nozzle being connected to at least one paint cartridge, which contains liquid paint whereby upon activation of the release lever the paint together with the compressed gas can flow into the inside of the balloon; a nozzle rod placed in the bore hole of the nozzle as well as the bore hole and the pressure bore hole of the hollow cylinder and is connected to the housing, which divides the bore hole and the pressure bore hole into a number of chambers which correspond to the number of arranged paint cartridges, whereby each chamber is connected with the arranged paint cartridge by means of a paint line.

9. A device according to claim 8, designated in such a way that each chamber is outfitted with a proportioning chamber having an elastic exterior wall.

10. A device according to claim 3, designated in such a way that the paint line in the area of the paint cartridge is outfitted with a check valve.

11. A device according to claim 8, designated in such a way that each paint line in the area of the paint cartridge is outfitted with one check valve.

* * * * *